United States Patent [19]

Pons et al.

[11] 4,248,629

[45] Feb. 3, 1981

[54] NICKEL- AND CHROMIUM-BASE ALLOYS POSSESSING VERY-HIGH RESISTANCE TO CARBURIZATION AT VERY-HIGH TEMPERATURE

[75] Inventors: Fernand Pons, Le Manoir sur Seine; Jacques Thuillier, Pont de L'Arche, both of France

[73] Assignee: Acieries du Manoir Pompey, Neuilly sur Seine, France

[21] Appl. No.: 935,800

[22] Filed: Aug. 22, 1978

[30] Foreign Application Priority Data

Mar. 22, 1978 [FR] France ..... 78 08338
Jun. 29, 1978 [FR] France ..... 78 19545

[51] Int. Cl.[3] ..... C22C 30/00; C22C 19/05

[52] U.S. Cl. ..... 75/122; 75/124; 75/134 C; 75/134 F; 75/171; 148/6.3; 148/6.35; 148/31.5

[58] Field of Search ..... 148/32, 38, 6.3, 6.35, 148/31.5; 75/122, 171, 134 F, 124, 125, 128 A, 128 N, 128 W, 128 G, 134 C

[56] References Cited

U.S. PATENT DOCUMENTS

| | | | |
|---|---|---|---|
| 2,994,605 | 8/1961 | Gill et al. | 75/171 |
| 3,989,514 | 11/1976 | Fujioka et al. | 75/122 |
| 4,035,182 | 7/1977 | Kowaka et al. | 75/122 |
| 4,050,928 | 9/1977 | Crum | 75/122 |
| 4,063,934 | 12/1977 | Thuillier et al. | 75/122 |
| 4,086,085 | 4/1978 | McGurty | 75/128 A |

FOREIGN PATENT DOCUMENTS

| | | |
|---|---|---|
| 946263 | 12/1948 | France . |
| 1251688 | 12/1960 | France . |
| 1267470 | 6/1961 | France . |

*Primary Examiner*—R. Dean
*Attorney, Agent, or Firm*—Kenyon & Kenyon

[57] ABSTRACT

The invention alloy has the following by-weight composition:

| | | | |
|---|---|---|---|
| carbon | 0.05 | to | 0.60% |
| nickel | 20 | to | 55% |
| chromium | 15 | to | 40% |
| silicon | 0.5 | to | 2% |
| manganese | 0.5 | to | 2% |
| nitrogen | 0.03 | to | 0.20% |
| niobium | 0 | to | 2% |
| tungsten and/or molybdenum | 0 | to | 5% |
| aluminium | 2 | to | 8% |
| copper | 0 | to | 5% |
| iron and usual impurities in as small quantities as possible | the balance | | |

an increased resistance to carburization is obtained by endogenous formation of a barrier opposing the penetration of aluminium.

18 Claims, 3 Drawing Figures

NICKEL- AND CHROMIUM-BASE ALLOYS POSSESSING VERY-HIGH RESISTANCE TO CARBURIZATION AT VERY-HIGH TEMPERATURE

The present invention relates to a nickel-, chromium-, carbon- and possibly iron-base heat-resisting alloy offering high resistance to carburization by carburizing agents, especially solid or gaseous carburizing agents, in particular at very high temperatures exceeding 1000° C. and even reaching 1150° C. or more.

The invention also relates to all articles, parts or products constituted by the said heat-resisting alloy. It relates, moreover, to a method of obtaining articles, products or parts possessing very-high resistance to carburization, based on the use of the said heat-resisting alloy.

Special alloys are known which offer good resistance to carburization by carburizing agents even at temperatures of the order of 1000° C. Such alloys, however, do not possess all the properties required for certain applications such as for example the structural elements used in installations intended for very-high-temperature processing in oxidizing and/or carburizing mediums, such as the tube or pipe stills employed in petrochemical plants. Some of such properties are, on the one hand, creep strength, resistance to oxidation, ductility, tensile strength within various temperature ranges including very-high temperatures, and on the other hand, weldability.

Moreover, the good resistance to carburization which some known alloys offer at high-temperatures, e.g. of the order of 1000° C., decreases at very-high temperatures, e.g. of the order of from 1100° to 1150° C.

Also worthwhile mentioning is the fact that it has already been proposed to protect heat-resisting alloys possessing a set of satisfactory properties with the exception of resistance to carburization and, possibly, resistance to oxidation, by an exogenous layer of aluminium and/or alumina applied to the alloy by any suitable means. In practice, the application of such an exogenous layer is difficult to perform or must be carried out with great care and its adherence to the alloy is poor or mediocore, so that the alloy is liable to premature carburization.

The alloy according to the present invention allows the above drawbacks to be obviated owing to the fact that it offers a set of adequate properties, particularly for the manufacture of structural elements of petrochemical plants, and that its resistance to carburization can be increased in service or by previous treatment.

This alloy is characterized in that it complies with the following composition (by weight):

| | | | |
|---|---|---|---|
| carbon | 0.05 | to | 0.60% |
| nickel | 20 | to | 55% |
| chromium | 15 | to | 40% |
| silicon | 0.5 | to | 2% |
| manganese | 0.5 | to | 2% |
| nitrogen | 0.03 | to | 0.20% |
| niobium | 0 | to | 2% |
| tungsten and/or molybdenum | 0 | to | 5% |
| aluminium | 2 | to | 8% |
| copper | 0 | to | 5% |
| iron and usual impurities in as small quantities as possible | the balance | | |

According to a more specific form of embodiment of the invention, the alloy has the following composition (by weight):

| | |
|---|---|
| carbon | 0.05 to 0.60% |
| nickel | 30 to 55% |
| chromium | 20 to 40% |
| silicon | 0.5 to 2% |
| manganese | 0.5 to 2% |
| nitrogen | 0.05 to 0.20% |
| niobium | 1 to 2% |
| tungsten and/or molybdenum | 0.2 to 5% |
| aluminium | 2 to 8% |
| copper | 0 to 5% |
| iron and usual impurities in as small amounts as possible | the balance |

Preferably, the aluminium content is from 2.5 to 6.5% by weight, more advantageously from 3.5 to 6%.

The very-high resistance to carburization which is acquired during service by the heat-resisting alloy of the present invention or which is imparted thereto by previous treatment is due to the presence of aluminium which, in a superficial region of the alloy, is at least partially in the aluminium oxide state forming a screen to the penetration of carbon into the alloy, by inhibiting or hindering the migration of this element. Thus, this superficial region or layer with high-aluminium-oxide of endogenous origin ensures an improvement of the resistance of the alloy to carburization, which is already normally good since the nature of the alloy matrix is austenitic, of the type with carbides.

Of course, the said superficial region, unlike an applied layer, has no definite internal boundary and no solution of continuity.

Moreover, there is no risk of the said superficial layer splitting off, as would be the case if it were of exogenous nature, i.e. if it were subsequently applied to an alloy containing no or too little aluminium to allow this element to play any part in the resistance of the alloy to carburization. In addition, owing to the possibility of transformation of an increasing portion of aluminium into aluminium oxide, and at increasing depth, the resistance to carburization of the alloy of the invention cannot but increase with time.

Another advantage of the composition according to the invention is that, in case the superficial oxidized region should be eliminated, e.g. by abrasion or in any other manner, it will immediately reappear in the underlying non-oxidized region of the metal.

Additional tests performed by the applicants have led them to believe that the protective layer constituting a barrier to oxidation and carburization might be continuous and of the superficial type and/or quite close to the contact surface between the alloy and the carburizing or oxidizing medium and that this layer might contain not only more or less oxidized aluminium but also silicon and chromium.

According to the present invention, the said alloy is also characterized by the following preferred composition:

| | | | |
|---|---|---|---|
| carbon | 0.10 | to | 0.50% |
| nickel | 35 | to | 50% |
| chromium | 20 | to | 35% |
| silicon | 0.5 | to | 2% |
| manganese | 0.5 | to | 2% |
| nitrogen | 0.05 | to | 0.20% |

-continued

| | | | |
|---|---|---|---|
| niobium | 1 | to | 2% |
| tungsten and/or molybdenum | 0.5 | to | 3.5% |
| aluminium | 2.50 | to | 6.50% |
| copper | 0 | to | 3% |
| iron | 0 | to | 40% |

In this preferred composition, the nickel, chromium and aluminium contents in a first case are, for example, of the order of 45%, 25% and 4% by weight, respectively, and in a second case, of the order of 40%, 20% and 6% by weight, respectively.

With a view to reducing costs, the proportions of some expensive elements of the alloy of the present invention may be selected within relatively narrow ranges nearer to the lower limits of the above general ranges. This applies not only to niobium, tungsten and molybdenum, but also to nickel and chromium. Thus, this alloy may comprise only 20 to 30% nickel and/or 15 to 20% chromium and/or 0 to 1% niobium and/or 0 to 0.2% (tungsten+molybdenum).

In a particular form of embodiment of the invention, the alloy has the following composition by weight:

| | |
|---|---|
| carbon | 0.05 to 0.60% |
| nickel | 20 to 35% |
| chromium | 15 to 25% |
| silicon | 0.5 to 2% |
| manganese | 0.5 to 2% |
| nitrogen | 0.03 to 0.10% |
| niobium | 0 to 1% |
| tungsten and/or molybdenum | 0 to 0.2% |
| aluminium | 2 to 8% |
| copper | 0 to 5% |
| iron and usual impurities in as small amounts as possible | the balance |

In addition to the usual impurities, the alloy according to the invention may also contain minor proportions of one or several elements selected from Ta, Co, V, Ti and Zr.

As appears from the compositions given above, the alloy of the invention may or may not contain copper, the presence of copper being more particularly required in those alloys of the present invention which are intended to operate at very high temperatures, e.g. of the order of 1100° C. or more.

According to one characterizing feature of the present invention, the carbon content is usually of the order of 0.4 to 0.5% by weight, except where the products or articles to be made from the alloy of the present invention are of elongated shape and intended to be bent or curved. Thus, in the case of structural elements constituted by pipes which have been bent or curved, the carbon content of the alloy is usually lower than 0.30%.

The treatment to which the products or articles of the alloy of the present invention may be subjected before being put into the service is, according to the present invention, a treatment for accelerated formation of the high-aluminium-oxide superficial region. According to one characterizing feature of the invention, this treatment consists in heating the said articles or products in an oxidizing atmosphere.

Apart from excellent resistance to carburization, especially at high temperature, the alloys of the present invention also possess the following properties:

good weldability;

excellent resistance to oxidation, to which the aluminium oxide formed in the aforesaid superficial layer or region contributes to a considerable extent;

good mechanical characteristics at room temperature as compared with other austenitic alloys offering or deprived of resistance to carburization; thus, tensile strength as well as ductility are considerably increased compared with such alloys;

high creep strength, especially at high temperature, together with hot ductility (creep ductility).

The upper-limit aluminium content of the alloy according to the invention is preferably 6.5%, because beyond that content the alloy would be too brittle for most of its applications. On the other hand, it is necessary to so co-ordinate the proportions of the various constituent elements of the alloy of the invention within the above-defined general ranges as to avoid inducing the formation of a sigma phase which would lead to considerably reduced ductility and increased brittleness of the alloy. In this respect, an appropriate equilibrium should be maintained between the elements having a tendency to induce the formation of ferrite, such as for example Cr, Si, Nb, Mo, W, Al and the elements tending to contribute to the formation of austenite, such as for example C, Ni, Mn, N, Cu, so that the structure as a whole remains that of an austenitic alloy.

Other characterizing features, purposes or advantages of the present invention will appear as the following non-limitative description proceeds with reference to the appended drawings wherein.

The above creeping and carburizing tests were performed on rough-cast alloys.

Various examples of alloys according to the invention are given herebelow.

EXAMPLE 1 (ALLOY XA2):

| | |
|---|---|
| carbon | 0.43% |
| nickel | 45.08% |
| chromium | 24.87% |
| silicon | 1.51% |
| manganese | 1.03% |
| nitrogen | 0.09% |
| niobium | 1.22% |
| tungsten | 1.62% |
| molybdenum | 0.14% |
| aluminium | 2.02% |
| copper | 0.12% |
| iron and impurities | 12.87% |

EXAMPLE 2 (ALLOY XA4):

| | |
|---|---|
| carbon | 0.41% |
| nickel | 46.70% |
| chromium | 25.98% |
| silicon | 1.37% |
| manganese | 1.16% |
| nitrogen | 0.10% |
| niobium | 1.25% |

-continued

| | |
|---|---|
| tungsten | 1.60% |
| molybdenum | 0.18% |
| aluminium | 4.28% |
| copper | 0.15% |
| iron and impurities | 16.82% |

EXAMPLE 3:

| | |
|---|---|
| carbon | 0.54% |
| nickel | 40% |
| chromium | 20% |
| silicon | 1.20% |
| manganese | 1.80% |
| nitrogen | 0.18% |
| niobium | 1.80% |
| tungsten | 2.5% |
| aluminium | 6.1% |
| iron and impurities | 25.88% |

EXAMPLE 4 (ALLOY KXA6):

| | |
|---|---|
| carbon | 0.40% |
| nickel | 25.30% |
| chromium | 20.10% |
| silicon | 1.60% |
| manganese | 1.00% |
| nitrogen | 0.06% |
| niobium | 1.20% |
| tungsten | 1.80% |
| molybdenum | 0.15% |
| aluminium | 5.95% |
| copper | 0.10% |
| iron and impurities | 42.34% |

EXAMPLE 5 (ALLOY KA6):

| | |
|---|---|
| carbon | 0.45% |
| nickel | 24.60% |
| chromium | 19.80% |
| silicon | 1.50% |
| manganese | 1.20% |
| nitrogen | 0.08% |
| tungsten | 0.10% |
| molybdenum | 0.18% |
| aluminium | 6.51% |
| copper | 0.18% |
| iron and impurities | 45.40% |

EXAMPLE 6 (ALLOY TXA6):

| | |
|---|---|
| carbon | 0.22% |
| nickel | 29.70% |
| chromium | 18.20% |
| silicon | 1.60% |
| manganese | 1.10% |
| nitrogen | 0.05% |
| niobium | 1.00% |
| tungsten | 1.10% |
| molybdenum | 0.20% |
| aluminium | 6.12% |
| copper | 0.25% |
| iron and impurities | 40.46% |

Table I below gives some mechanical characteristics of XA2 and XA4 alloys at room temperature.

TABLE I

| Alloy | Re | Rm | A | Z |
|---|---|---|---|---|
| X A2 | 320 | 590 | 21 | 21 |
| X A4 | 470 | 700 | 13 | 15 |

Re = elastic limit (kg/cm$^2$)
Rm = breaking load (kg/cm$^2$)
A = elongation (%)
Z = reduction in area The applicants have found that the alloys having the same composition as alloys XA4 and XA6, but containing no aluminium possess lower ductility as well as lower tensile strength. The increased tensile strength due to the presence of aluminium within the range of proportions according to the invention seems to result from the presence of a precipitated phase homogeneously dispersed in the form of fine particles within the matrix.

Figure 1:
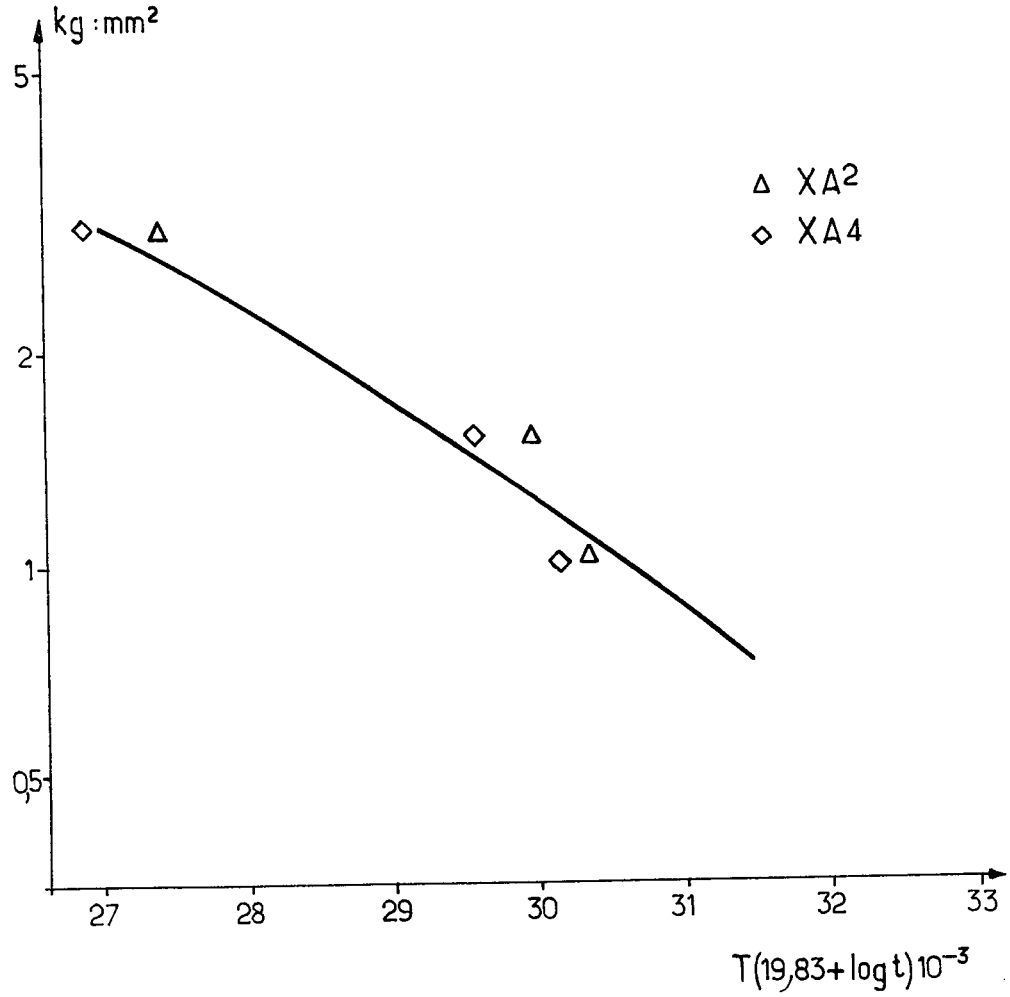
FIG. 1 is a diagram of the result of creeping tests at 980° C., 1100° C. and 1150° C. performed on two alloys according to the present invention, designated as XA2 and XA4.

Table II below gives the results of creeping tests performed on the two aforementioned XA2 and XA4 alloys at the following temperatures: 980° C., 1100° C. and 1150° C. Those test results are also illustrated by the curve in FIG. 1, where T is the temperature in °K. and t is the time elapsed up to the instant of breakage.

TABLE II

Creep fracture test
Cylindrical test-pieces 8 mm in diameter and 40 mm in length

| | | Alloy X A2 | | Alloy X A4 | |
|---|---|---|---|---|---|
| Temperature (°C.) | Stress (kg/mm$^2$) | Time (hr)* | A (%) | Time (hr)* | A (%) |
| 980° | 3 | 107.1 | 22 | 41.4 | 20 |
| 1050° | 1.5 | 679.9 | 8 | 306.2 | 12 |
| 1100° | 1.0 | 151 | 8 | 134.0 | 10 |

*Time elapsed up to breaking
A = elongation (%)

It will be observed that the XA2 alloy offers higher creep strength than the XA4 alloy, although the creep strength of the latter is already quite satisfactory. Also to be noted is the excellent hot ductility or creep ductility of these alloys as disclosed by the elongation values A.

Figure 3:
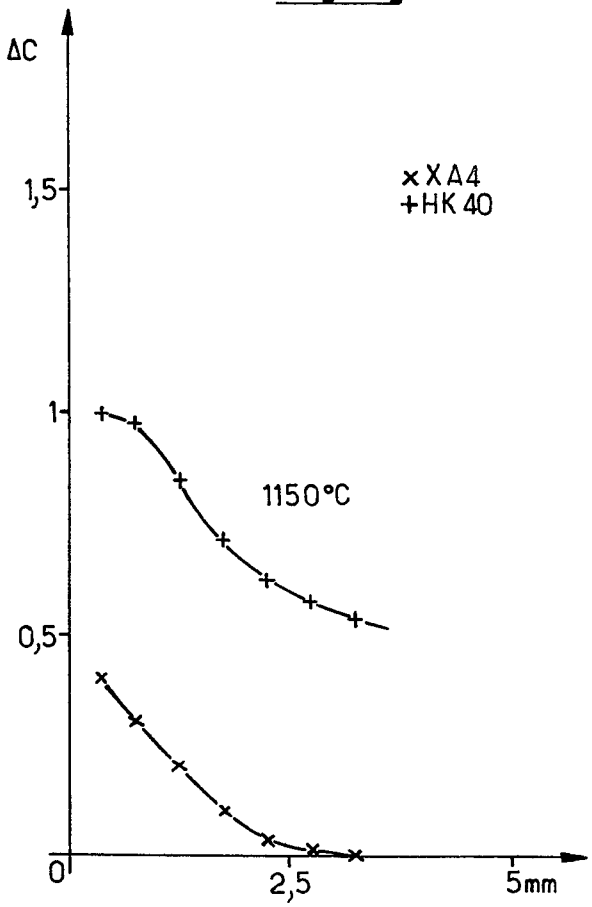
FIG. 3 is a diagram of the results of carburization tests performed at 1150° C. on the same alloys XA4 and HK40.
Figure 2:
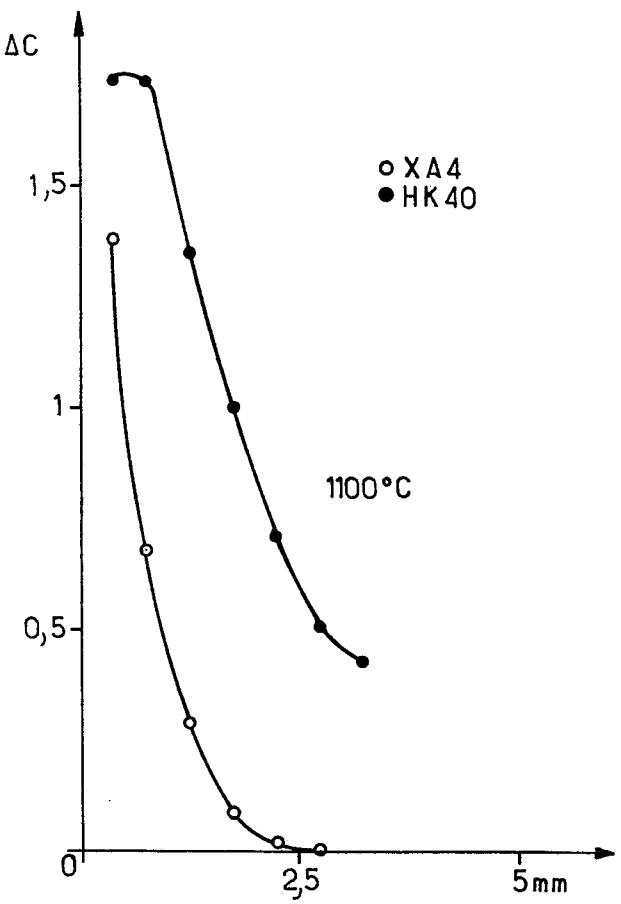
FIG. 2 is a diagram of the results of carburization tests performed at 1100° C. on the alloy XA4 and on the known alloy HK40.

Table III below gives the results of carburizing tests performed on the XA4 alloy at 1100° C. and at 1150° C. Also shown in the same Table are the results of the same tests performed on the known HK40 alloy. All these tests are also illustrated by FIGS. 2 and 3.

TABLE III

Carburization with solid carburizing agent during 4 days
Cylindrical test-pieces 50 mm long and 10 mm in diameter

| Distance (in mm) | Increase in carbon content (ΔC) at 1100° C. | | Increase in carbon content at 1150° C. | |
|---|---|---|---|---|
| from outer surface of test-piece | HK40 alloy | X A4 alloy | HK40 alloy | X A4 alloy |
| 0.2 to 0.5 mm | 1.73 | 1.38 | 1.00 | 0.41 |
| 0.5 to 1 | 1.73 | 0.68 | 0.98 | 0.31 |
| 1.5 | 1.35 | 0.29 | 0.85 | 0.21 |
| 2 | 1.01 | 0.09 | 0.72 | 0.09 |
| 2.5 | 0.71 | 0.02 | 0.63 | 0.03 |
| 3 | 0.51 | 0 | 0.58 | 0.01 |
| 3.5 | 0.44 | 0 | 0.54 | 0 |
| Σ* | 7.48 | 2.46 | 5.30 | 1.07 |

*Σ = sums of increases ΔC at the various indicated distances

The carburizing test was carried out on cylindrical bars 10 mm in diameter and 50 mm long. The bars were kept four days at the aforesaid temperature in the presence of a solid carburizing agent.

It will be noted that the XA4 alloy, containing 4% aluminium possesses considerably improved resistance to carburization as compared with the HK40 alloy.

The tests, the results of which are given in Tables I to III, were performed on rough-cast alloys which had not been subjected to any previous particular treatment and not yet put into a service. Of course, the superficial layer of the alloys contained aluminium oxide at the end of the tests, owing to the very strong tendency of aluminium to form aluminium oxide rather than, for example, carbides. Obviously and as mentioned earlier, resistance to carburization as well as resistance to oxidation can only improve with time, due to the possibility of progressive formation of aluminium oxide in the superficial layer.

The alloys of examples 3 to 6 were subjected to solid-cement carburization tests for 4 days at 980° C., 1100° C. and 1150° C. No sign of carbon pick-up was observed at a depth greater than 1 mm from the surface in contact with the carburizing agent.

All the aforementioned alloys possess excellent resistance to oxidation and to carburization at high temperature, which can be explained by the formation of a layer forming a barrier to oxidation and carburization, as mentioned above, which results not only from the presence of aluminium, but also of chromium and silicon.

Of course the invention is by no means limited to the forms of embodiment described and illustrated which have been given by way of example only. In particular, it comprises all means constituting technical equivalents to the means described, as well as their combinations, should the latter be carried out according to its gist and used within the scope of the following claims.

What is claimed is:

1. A nickel-chromium alloy having high mechanical properties, high weldability, high creep strength and resistance to oxidation, and high resistance to carburization, consisting essentially of the following elements in weight percent:

| | | | |
|---|---|---|---|
| carbon | 0.05 | to | 0.60 |
| nickel | 20 | to | 55 |
| chromium | 15 | to | 40 |
| silicon | 0.5 | to | 2 |
| manganese | 0.5 | to | 2 |
| nitrogen | 0.03 | to | 0.20 |
| niobium | 0 | to | 2 |
| tungsten and/or molybdenum | 0 | to | 5 |
| aluminium | 2 | to | 8 |
| copper | 0 | to | 5 |
| iron | the balance, | | |

said alloy being capable of acquiring increased resistance to carburization as a result of the formation, during service or by appropriate treatment prior to being put into the service, of a barrier opposing the penetration of carbon.

2. An alloy according to claim 1, consisting essentially of the following elements in weight percent:

| | | | |
|---|---|---|---|
| carbon | 0.05 | to | 0.60 |
| nickel | 30 | to | 55 |
| chromium | 20 | to | 40 |
| silicon | 0.5 | to | 2 |
| manganese | 0.5 | to | 2 |
| nitrogen | 0.05 | to | 0.20 |
| niobium | 1 | to | 2 |

-continued

| | | | |
|---|---|---|---|
| tungsten and/or molybdenum | 0.2 | to | 5 |
| aluminium | 2 | to | 8 |
| copper | 0 | to | 5 |
| iron | the balance, | | |

3. An alloy according to claim 2 containing 2.5 to 6.5% by weight of aluminium.

4. An alloy according to claim 2 consisting essentially of the following by weight composition:

| | |
|---|---|
| carbon | 0.10 to 0.50% |
| nickel | 35 to 50% |
| chromium | 20 t0 35% |
| silicon | 0.5 to 2% |
| manganese | 0.5 to 2% |
| nitrogen | 0.05 to 0.20% |
| niobium | 1 to 2% |
| tungsten and/or molybdenum | 0.5 to 3.5% |
| aluminium | 2.50 to 6.50% |
| copper | 0 to 3% |
| iron | 0 to 40% |

5. An alloy according to claim 4 containing about 45% by weight nickel, about 25% by weight chromium and about 4% by weight aluminium.

6. An alloy according to claim 4 containing about 40% by weight nickel, about 20% by weight chromium and about 6% by weight aluminium.

7. An alloy according to claim 1 containing by weight:

| | | | |
|---|---|---|---|
| nickel | 20 | to | 35% |
| chromium | 15 | to | 25% |
| nitrogen | 0.03 | to | 0.10% |
| niobium | 0 | to | 1% |
| tungsten and/or molybdenum | 0 | to | 0.2% |

8. An alloy according to claim 1 containing 20 to 30% by weight nickel.

9. An alloy according to claim 1 containing 15 to 20% by weight chromium.

10. An alloy according to claim 1 containing 0 to 1% by weight niobium.

11. An alloy according to claim 1 containing 0 to 0.2% by weight molybdenum.

12. Articles fabricated from an alloy consisting essentially of the following by weight composition:

| | |
|---|---|
| carbon | 0.05 to 0.60% |
| nickel | 20 to 55% |
| chromium | 15 to 40% |
| silicon | 0.5 to 2% |
| manganese | 0.5 to 2% |
| nitrogen | 0.03 to 0.20% |
| niobium | 0 to 2% |
| tungsten and/or molybdenum | 0 to 5% |
| aluminium | 2 to 8% |
| copper | 0 to 5% |
| iron | the balance. |

13. A method of obtaining articles possessing high resistance to carburization comprising fabricating said articles in their final shape from an alloy consisting essentially of the following by weight composition:

| | |
|---|---|
| carbon | 0.05 to 0.60% |
| nickel | 20 to 55% |
| chromium | 15 to 40% |

-continued

| | |
|---|---|
| silicon | 0.5 to 2% |
| manganese | 0.5 to 2% |
| nitrogen | 0.03 to 0.20% |
| niobium | 0 to 2% |
| tungsten and/or molybdenum | 0 to 5% |
| aluminum | 2 to 8% |
| copper | 0 to 5% |
| iron | the balance |

and then in subjecting said articles to a treatment for accelerated endogenous formation of a barrier to the penetration of carbon into said articles.

14. A method according to claim 13 wherein said treatment comprises heating said articles in an oxidizing atmosphere.

15. An alloy according to claim 3 wherein the aluminium content is 3.5% to 6% by weight.

16. Articles made in their final form from an alloy consisting essentially of the following elements in weight percent:

| | | |
|---|---|---|
| carbon | 0.05 to 0.60 | [%] |
| nickel | 20 to 55 | [%] |
| chromium | 15 to 40 | [%] |
| silicon | 0.5 to 2 | [%] |
| manganese | 0.5 to 2 | [%] |
| nitrogen | 0.05 to 0.20 | |
| niobium | 0 to 2 | |
| tungsten and/or molybdenum | 0 to 5 | |
| aluminum | 2 to 8 | |
| copper | 0 to 5 | |
| iron | the balance, | |

said articles having been subjected to a treatment for accelerated endogenous formation of a barrier to the penetration of carbon into said articles.

17. Articles according to claim 16 wherein said treatment comprised heating said articles in an oxidizing atmosphere.

18. An alloy according to claim 2 wherein the tungsten and/or molybdenum content is 1 to 3 weight percent.

* * * * *

UNITED STATES PATENT AND TRADEMARK OFFICE

CERTIFICATE OF CORRECTION

PATENT NO. : 4,248,629

DATED : February 3, 1981

INVENTOR(S) : Fernand Pons et al.

It is certified that error appears in the above—identified patent and that said Letters Patent is hereby corrected as shown below:

Column 10, lines 2 - 6: delete " /_ % _/

Signed and Sealed this

*Twenty-third* Day of *June 1981*

[SEAL]

*Attest:*

RENE D. TEGTMEYER

*Attesting Officer*

*Acting Commissioner of Patents and Trademarks*